US008662984B2

(12) United States Patent
Haga et al.

(10) Patent No.: US 8,662,984 B2
(45) Date of Patent: Mar. 4, 2014

(54) GAMING MACHINE AND GAMING MACHINE REEL ASSEMBLY

(75) Inventors: Matthew H. Haga, Austin, TX (US); Frank C. DeSimone, Henderson, NV (US); Leroy H. Gutknecht, Las Vegas, NV (US)

(73) Assignee: Multimedia Games, Inc., Austin, TX (US)

( * ) Notice: Subject to any disclaimer, the term of this patent is extended or adjusted under 35 U.S.C. 154(b) by 1621 days.

(21) Appl. No.: 11/942,677

(22) Filed: Nov. 19, 2007

(65) Prior Publication Data

US 2008/0119263 A1 May 22, 2008

Related U.S. Application Data

(60) Provisional application No. 60/866,384, filed on Nov. 17, 2006.

(51) Int. Cl.
*A63F 9/00* (2006.01)

(52) U.S. Cl.
USPC ..... 463/20

(58) Field of Classification Search
USPC ..... 463/20
See application file for complete search history.

(56) References Cited

U.S. PATENT DOCUMENTS 1,854,479 A * 4/1932 Mills ..... 273/143 R
1,978,395 A * 10/1934 Groetchen ..... 273/143 R
2,866,246 A * 12/1958 Waldes ..... 24/669
3,631,806 A * 1/1972 Barthalon ..... 104/89
3,677,451 A * 7/1972 Burland ..... 224/322
3,705,468 A * 12/1972 Ashworth ..... 49/409
3,744,647 A * 7/1973 Jelinek ..... 211/175
3,845,982 A * 11/1974 Pickles ..... 296/68.1
3,910,582 A 10/1975 Richards
4,030,699 A * 6/1977 Heimke ..... 254/108
4,068,887 A * 1/1978 Babbs ..... 297/216.18
4,072,375 A * 2/1978 Boone ..... 312/334.8
4,107,862 A * 8/1978 Sofinowski, III ..... 42/50
4,189,893 A * 2/1980 Kuhr ..... 52/506.07
4,262,906 A 4/1981 Heywood
4,358,114 A 11/1982 Burnside
4,410,178 A 10/1983 Partridge
4,511,274 A * 4/1985 Chen ..... 402/21

(Continued)

FOREIGN PATENT DOCUMENTS

GB 2 145 266 A 3/1985

*Primary Examiner* — Seng H Lim
(74) *Attorney, Agent, or Firm* — Nathan H. Calvert, Esq.; Russell D. Culbertson, Esq.; J P Cody, Esq.

(57) ABSTRACT

A reel assembly includes a mounting bracket including a substantially planar mounting bracket body. A reel motor is connected to a first lateral side of the mounting bracket and a reel superstructure is connected to be driven by the reel motor about a rotational axis extending substantially perpendicular to the plane of the mounting bracket body. A mounting flange is located at a top edge of the mounting bracket. This mounting flange includes a substantially planar surface lying in a plane extending transversely to the plane of the mounting bracket body, preferably forming a "T" shape with the planar mounting bracket body as viewed in transverse section. A stabilizing structure is located at a rear edge of the mounting bracket in a spaced apart relationship with the mounting flange, and a locking structure is located at an intersection of the top edge of the mounting bracket and the front edge of the mounting bracket.

17 Claims, 6 Drawing Sheets

(56) References Cited

U.S. PATENT DOCUMENTS

| | | | | |
|---|---|---|---|---|
| 4,600,197 | A * | 7/1986 | Bean | 273/143 R |
| 4,693,477 | A | 9/1987 | Dickinson et al. | |
| 4,754,658 | A | 7/1988 | Gutknecht | |
| 4,861,183 | A * | 8/1989 | Loos | 403/354 |
| 5,067,712 | A | 11/1991 | Georgilas | |
| 5,102,136 | A | 4/1992 | Heidel et al. | |
| 5,186,517 | A * | 2/1993 | Gilmore et al. | 296/214 |
| 5,209,477 | A | 5/1993 | Heidel et al. | |
| 5,388,829 | A | 2/1995 | Holmes | |
| 5,423,540 | A | 6/1995 | Taxon | |
| 5,683,296 | A | 11/1997 | Rasmussen | |
| 5,688,172 | A | 11/1997 | Lorenzo Regidor | |
| 5,839,957 | A | 11/1998 | Schneider et al. | |
| 5,938,529 | A | 8/1999 | Rodesch et al. | |
| 5,988,638 | A * | 11/1999 | Rodesch et al. | 273/143 R |
| 6,003,867 | A | 12/1999 | Rodesch et al. | |
| 6,027,115 | A * | 2/2000 | Griswold et al. | 273/143 R |
| 6,102,396 | A | 8/2000 | Liu | |
| 6,129,355 | A | 10/2000 | Hahn et al. | |
| 6,394,900 | B1 | 5/2002 | McGlone et al. | |
| 6,790,140 | B1 * | 9/2004 | Niwa | 463/20 |
| 6,802,507 | B2 | 10/2004 | Inoue | |
| 6,824,466 | B1 * | 11/2004 | Hirota | 463/20 |
| 6,860,814 | B2 | 3/2005 | Cole | |
| 6,926,605 | B2 | 8/2005 | Nguyen et al. | |
| 7,232,127 | B2 * | 6/2007 | Seelig et al. | 273/143 R |
| 7,309,285 | B2 * | 12/2007 | Nordman et al. | 463/31 |
| 7,461,842 | B2 * | 12/2008 | Wu | 273/142 R |
| 7,744,460 | B2 * | 6/2010 | Walker et al. | 463/21 |
| 7,887,408 | B2 * | 2/2011 | Walker et al. | 463/20 |
| 2002/0187826 | A1 * | 12/2002 | Seymour et al. | 463/20 |
| 2003/0027627 | A1 * | 2/2003 | Cole | 463/20 |
| 2004/0053699 | A1 * | 3/2004 | Rasmussen et al. | 463/46 |
| 2004/0132522 | A1 | 7/2004 | Seelig et al. | |
| 2004/0142752 | A1 * | 7/2004 | Gauselmann | 463/46 |
| 2004/0171418 | A1 * | 9/2004 | Okada | 463/20 |
| 2004/0251625 | A1 * | 12/2004 | Okada | 273/143 R |
| 2005/0130746 | A1 * | 6/2005 | Stephenson et al. | 463/46 |
| 2005/0140088 | A1 | 6/2005 | Randall | |
| 2005/0159210 | A1 | 7/2005 | Satoh | |
| 2005/0255907 | A1 | 11/2005 | Gauselmann et al. | |
| 2006/0247023 | A1 * | 11/2006 | Inoue | 463/25 |
| 2007/0158904 | A1 * | 7/2007 | Okada | 273/138.1 |
| 2009/0176550 | A1 * | 7/2009 | Cove | 463/20 |

* cited by examiner

GAMING MACHINE AND GAMING MACHINE REEL ASSEMBLY

CROSS-REFERENCE TO RELATED APPLICATION

The Applicants claim the benefit, under 35 U.S.C. §119(e), of U.S. Provisional Patent Application No. 60/866,384, filed Nov. 17, 2006, and entitled "Reel Mount for a Gaming Machine Cabinet." The entire content of this provisional application is incorporated herein by this reference.

TECHNICAL FIELD OF THE INVENTION

This invention relates to gaming machines used to present results in wagering games and other games. More particularly, the invention relates to gaming machines that use one or more spinnable reels in the course of conducting a game and to a reel mounting system for use in mounting spinnable reels in a gaming machine cabinet. The invention encompasses both a reel assembly for a gaming machine and a gaming machine employing the reel assembly.

BACKGROUND OF THE INVENTION

Mechanical reel-type gaming machines include spinnable reels having graphical symbols spaced apart along the periphery of each reel. When the reels are at rest a portion of the periphery of each reel is visible through a viewing window, and one or more pay lines may be defined through the visible symbols. The symbols that line up along a given pay line for a given play in the game indicate the result for that play. Traditional reel-type gaming machines included complicated mechanical reel spinning arrangements for causing the reels to spin and ultimately come to a stop for a given play in the game. Modern reel-type gaming machines employ electrical motors to spin and stop the reels.

As gaming machines have evolved, so have the cabinets used to house the various gaming machine components. In many cases it is desirable for the gaming machine cabinet to be slim and take up a minimum of casino floor space. Yet the cabinets must securely house the various gaming machine components, including electronic components such as various controllers and processing devices, and mechanical or electro mechanical components such as the spinnable reels. Also, the various gaming machine components must be housed in a manner to allow proper cooling during operation, particularly for the powerful processing devices commonly used in modern gaming machines.

Prior electro mechanical reel-type gaming machines have employed a shelf mounted within the gaming machine cabinet on which the various reels and related components have been mounted. Some modern electro mechanical gaming machines use reel assemblies that combine the reel, reel driving motor, and other components on a suitable fixture that may be installed in the gaming machine cabinet as a unit. Various mounting arrangements have been developed for mounting these reel assemblies in the gaming machine cabinet. Despite improvements in reel assemblies and reel assembly mounting arrangements, there remains a need in the art for a reel assembly that requires minimum cabinet space, and facilitates good circulation within the cabinet to allow improved heat dissipation. There also remains a need in the art for a reel assembly that can be installed or replaced rapidly without affecting other gaming machine components.

SUMMARY OF THE INVENTION

The present invention is directed to a reel assembly and reel mounting arrangement that addresses the above-described issues and others associated with reel-type gaming machines. The invention encompasses both a reel assembly and a gaming machine adapted to receive the reel assembly.

A reel assembly according to one preferred form of the invention includes a mounting bracket including a substantially planar mounting bracket body. A reel motor is connected to a first lateral side of the mounting bracket and a reel superstructure is connected to be driven by the reel motor about a rotational axis extending substantially perpendicular to the plane of the mounting bracket body. A mounting flange is located at a top edge of the mounting bracket. This mounting flange includes a substantially planar surface lying in a plane extending transversely to the plane of the mounting bracket body, preferably forming a "T" shape with the planar mounting bracket body as viewed in transverse section. A stabilizing structure is located at a rear edge of the mounting bracket in a spaced apart relationship with the mounting flange, and a locking structure is located at an intersection of the top edge of the mounting bracket and the front edge of the mounting bracket.

This reel assembly is adapted to be used in a gaming machine having a receiving structure that supports the reel assembly from above so that the reel assembly hangs in a proper installed position. This reel assembly supporting arrangement allows for a very compact cabinet design and still facilitates good circulation within the gaming machine cabinet to allow proper heat dissipation from various gaming machine components.

A reel-type gaming machine according to one preferred form of the invention includes a cabinet defining an interior volume between two cabinet sides. The cabinet also includes a front door which may be placed in an open position to provide access to a front opening of the cabinet, and a closed position covering the cabinet front opening. The front door including a viewing panel through which reels are visible when mounted in the cabinet according to the invention. A mounting plate is mounted in the interior volume of the cabinet in a location above the viewing panel of the front door when the front door is in the closed position. This mounting plate extends laterally between the cabinet sides. A respective slot structure is included in the gaming machine for each reel to be included therein. Each slot structure is supported on the mounting plate and includes a downwardly facing slot defined between a first side component and a second side component. Each slot structure further includes a receiver area made up of a first side receiver area associated with the first side component and a second side receiver area associated with the second side component. Each slot structure is also associated with a respective stabilizing receiver, a respective electrical socket, and a respective lock element.

Each slot structure is adapted to receive the mounting flange of a respective reel assembly. A rear edge of the mounting flange may be aligned with the front of the slot structure, and then inserted into the slot structure to an installed operating position in which the projection on the mounting bracket is received in the stabilizing receiver and an electrical connector on the reel assembly makes a connection with the electrical socket associated with the slot structure. In this installed position, the slot structure of the gaming machine securely receives the mounting flange of the reel assembly and both the electrical connection arrangement and stabilizing receiver/projection arrangement cooperate to stabilize the reel assembly from side-to-side movement. The reel assembly may be removed quickly and easily without having to interfere with any adjacent reel assemblies in the gaming machine.

These and other advantages and features of the invention will be apparent from the following description of preferred embodiments, considered along with the accompanying drawings.

DESCRIPTION OF PREFERRED EMBODIMENTS

Figure 1:
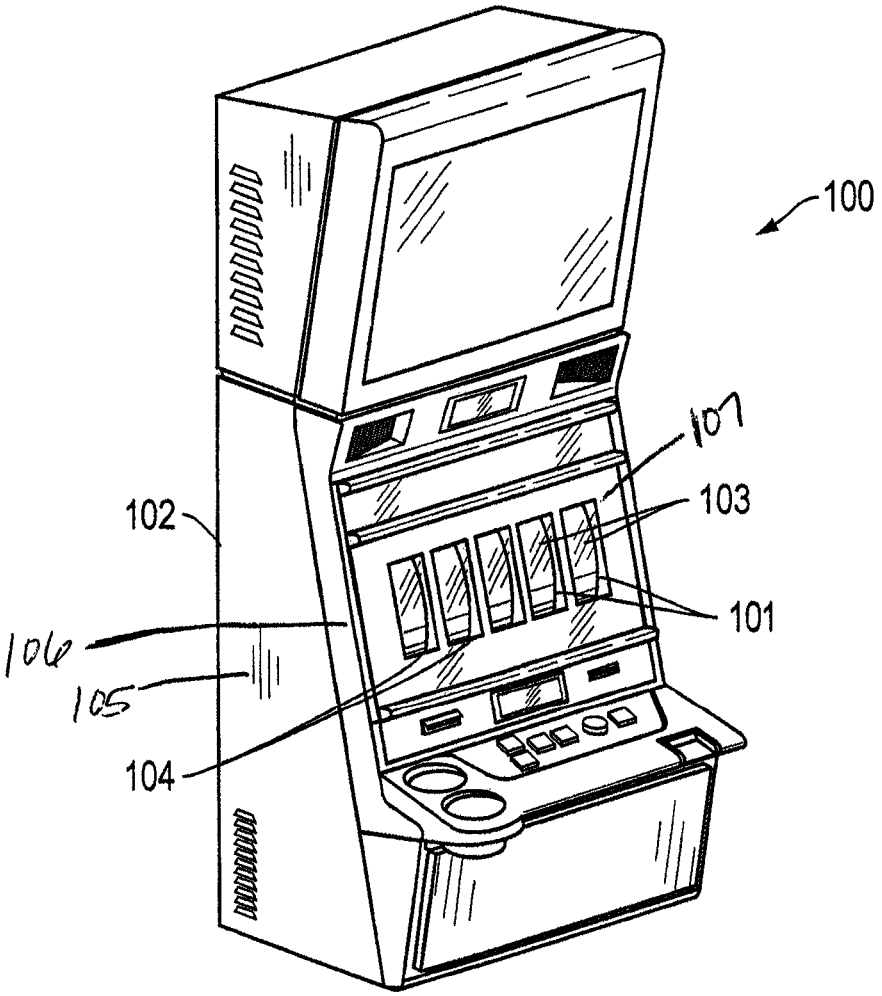
FIG. 1 is a left front perspective view of a mechanical reel gaming machine that may employ a mechanical reel mount according to the present invention.

FIG. 1 shows a gaming machine 100 having a number of spinnable reels 101 housed in a gaming machine cabinet 102. As is known in the art of mechanical reel-type gaming machines, each reel 101 includes a series of graphic symbols (symbols not shown in FIG. 1) on its outer surface 103. With the reels 101 in a stationary position, the graphic symbols visible through windows 104 make up an array of graphic symbols. One or more paylines or other patterns of these graphic symbols visible through windows 104 may be correlated to a game result, and thus may be used to display the game result to the player standing in front of gaming machine 100. Example gaming machine 100 includes a set of five reels 101, however, the invention is not limited to any particular number of reels.

Gaming machine cabinet 102 is made up of a series of enclosure elements so as to define an interior volume that will be described further below in connection with FIGS. 2 and 3. FIG. 1 shows one of the laterally spaced apart sides 105 which define the width of gaming machine cabinet 102. A front door 106 is also visible in FIG. 1. Front door 106 carries a viewing panel 107 in which windows 104 are formed. In one preferred form of gaming machine 100, viewing panel 107 comprises a sheet of glass on which artwork is silkscreened or otherwise formed, leaving only the windows 104 transparent for viewing reels 101. The position of front door 106 shown in FIG. 1 represents a closed position in which it covers a portion of a front opening of gaming machine cabinet 102. The position of gaming machine 100 shown in FIG. 1 represents an operating position for the gaming machine. It should be noted here that any terms indicating relative position used in this disclosure and the accompanying claims such as "front," "rear," "lateral," "back," and "top," for example, are used with reference to the operating position of gaming machine 100 shown in FIG. 1.

Figure 2:
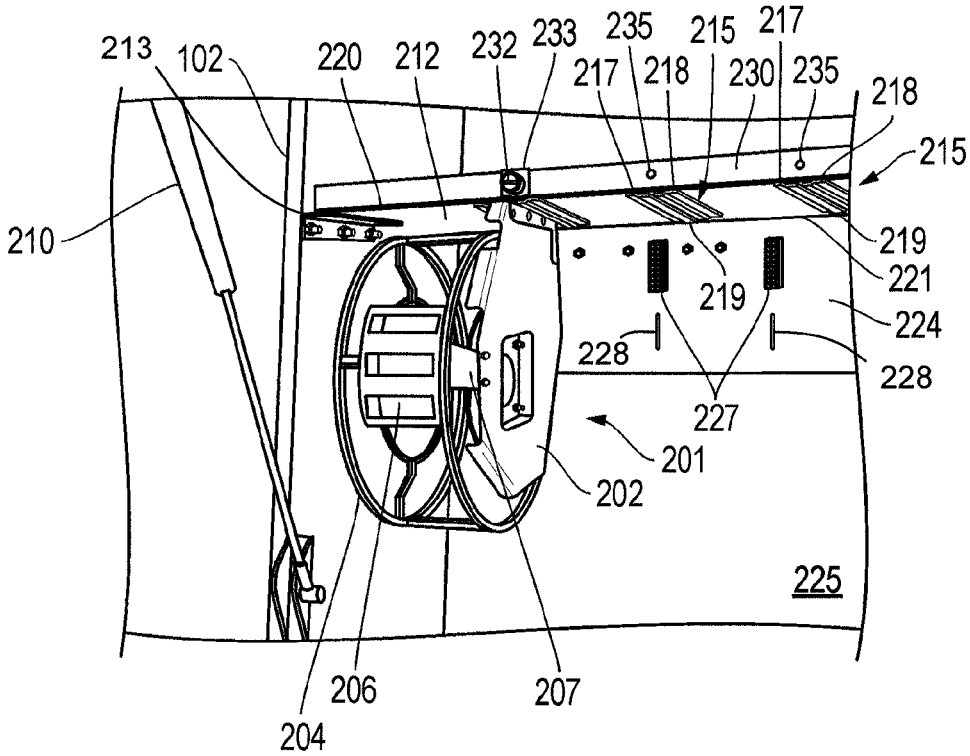
FIG. 2 is a right front perspective view of a mechanical reel mounted in a gaming machine cabinet according to the present invention.
Figure 3:
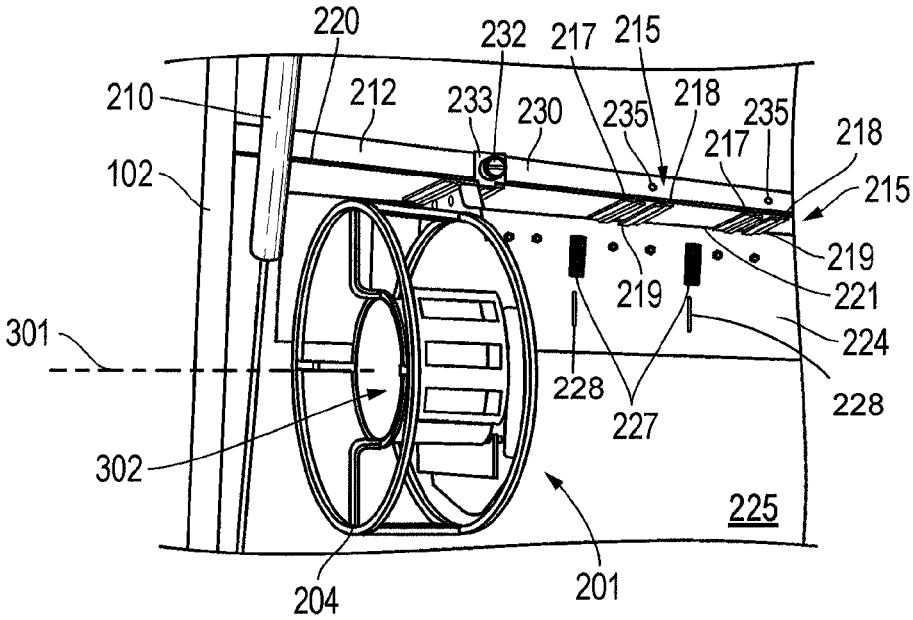
FIG. 3 is a left front perspective view of the mechanical reel and mounting arrangement shown in FIG. 2.

FIGS. 2 and 3 show a reel assembly 201 embodying the principles of the invention in an operating position in gaming machine cabinet 102. Reel assembly 201 includes a mounting bracket 202 which ultimately supports a reel superstructure 204. Reel superstructure 204 is adapted to support a reel strip (not shown) which is wrapped around reel superstructure 204 to form a substantially cylindrical shape and on which the reel graphic symbols are printed or otherwise formed. It is this reel strip material which forms the reel surfaces 103 shown in FIG. 1. The example reel assembly 201 shown in FIGS. 2 and 3 includes a back light assembly 206 which carries a number of lights (not shown) for backlighting certain areas of the reel strip material mounted on reel superstructure 204. Backlight assembly 206 is connected to mounting bracket 202 via a backlight bracket 207. Although not shown in FIGS. 2 and 3, reel assembly 201 includes a suitable motor for driving the reel superstructure 204 and its associated reel-strip about a rotational axis shown at 301 in FIG. 3. Typically, the motor will occupy much of the area at the center of the reel superstructure shown generally at 302 in FIG. 3 and a stationary portion of the motor will be connected to mounting bracket 202 with suitable screws or other connectors. A rotor or shaft of the motor will be connected to reel superstructure 204. The motor preferably comprises a stepper motor and is associated with various electronic devices which are also included in assembly 201 but not shown in the figures. The electronics associated with the drive motor and with backlight assembly 206, along with the various connecting wires or conductor traces between the various elements on reel assembly 201 are generally omitted from the figures so as not to obscure the present invention and unnecessary detail. The present reel mounting arrangement is applicable to substantially any suitable reel structure and reel drive arrangement and associated electronics that may be mounted on a vertical mounting bracket 202 according the present invention.

As is apparent from the perspective of FIG. 2, mounting bracket 202 in the illustrated form of the invention includes a substantially planar mounting bracket body 203 having one lateral side exposed in the perspective of FIG. 2 and an opposite lateral side facing the reel superstructure 204. A suitable mounting bracket 202 may be made from a suitable rigid material such as sheet metal which is stamped or otherwise formed in the configuration shown in the figures. Any suitable material may be used for mounting bracket 202. Also, it is not necessary for mounting bracket 202 to comprise a solid plate as shown in the figures. Alternative forms of the invention may include a number of elements connected together in some fashion to provide a thin, planar structure for supporting the various elements of reel assembly 201.

FIGS. 2 and 3 also show a portion of the interior of gaming machine cabinet 102 in which the various reel assemblies 201 are mounted. The particular gaming machine 100 depicted in FIGS. 1 through 3 includes an upwardly opening door 106 (shown only in FIG. 1) which is supported in the open position with one or more hydraulic or pneumatic shocks 210. The area of gaming machine cabinet 102 which houses reel assemblies 201 is exposed from the front of the gaming machine in this open position shown in FIGS. 2 and 3. All of the reel assemblies 201 included in gaming machine 100 are supported from a mounting plate 212 which is supported substantially horizontally in gaming machine cabinet 102 by a suitable supporting arrangement. The supporting arrangement shown in the illustrated example comprises side support brackets 213 which are connected to cabinet side 105 and support each lateral side of mounting plate 212 (only one cabinet side 105 and support bracket 213 are visible in the perspective of FIG. 2). Mounting plate 212 includes a slot structure 215 for each reel assembly 201 included in gaming machine cabinet 102. The partial views of gaming machine cabinet 102 shown in FIGS. 2 and 3 show a single reel assembly 201 mounted on one of the slot structures 215 while the two adjacent slot structures are unoccupied by a respective reel assembly. Referring to the unoccupied slot structures 215, each such structure includes a left side component 217 and a right side component 218 which are each connected by suitable means to mounting plate 212 and spaced apart to define a downwardly facing slot 219 that extends from a front edge 220 of the mounting plate toward a back edge 221 of the mounting plate. FIGS. 2 and 3 also show a backplane 224 mounted on a back wall 225 of gaming machine cabinet 102 and extending substantially perpendicular to the plane of mounting plate 212. In this particular embodiment, backplane 224 includes a respective cabinet electrical connector 227 for each reel assembly 201 to be included in the gaming machine. Backplane 224 also includes a respective stabilizing receiver 228, which, in this preferred form of the invention, comprises a vertical slot for receiving a stabilizing projection of reel assembly 201 as will be described below.

It will be noted that although FIGS. 2 and 3 show both the cabinet electrical connectors 227 and the stabilizing receivers 228 mounted on or formed on backplane 224, this arrangement is not a requirement of the invention. Rather, cabinet electrical connectors 227 and the stabilizing receivers 228 may not be associated with the machine backplane 224, and may instead be mounted on or supported on any suitable structure or wall at the back of the gaming machine cabinet 102.

The illustrated example mounting plate 212 includes an upturned front flange 230. This upturned front flange 230 increases the rigidity of mounting plate 215 and also provides a connecting point for a connecting screw 232 which forms part of a locking structure associated with reel assembly 201. The locking structure in the illustrated embodiment includes connecting screw 232 and a locking flange 233 of the respective reel assembly 201. Connecting screw 232 preferably includes an enlarged knurled surface portion to facilitate turning the screw by hand without requiring any tools. Locking flange 233 includes a suitable opening for receiving connecting screw 232 and, for each slot structure 215 the upturned front flange 230 includes a respective threaded opening 235 for receiving the threaded end of the connecting screw for a respective reel assembly 201. It will be noted from FIGS. 2 and 3 that locking flange 233 lies in a plane extending generally perpendicular to the plane of mounting bracket body 203.

Figure 4:
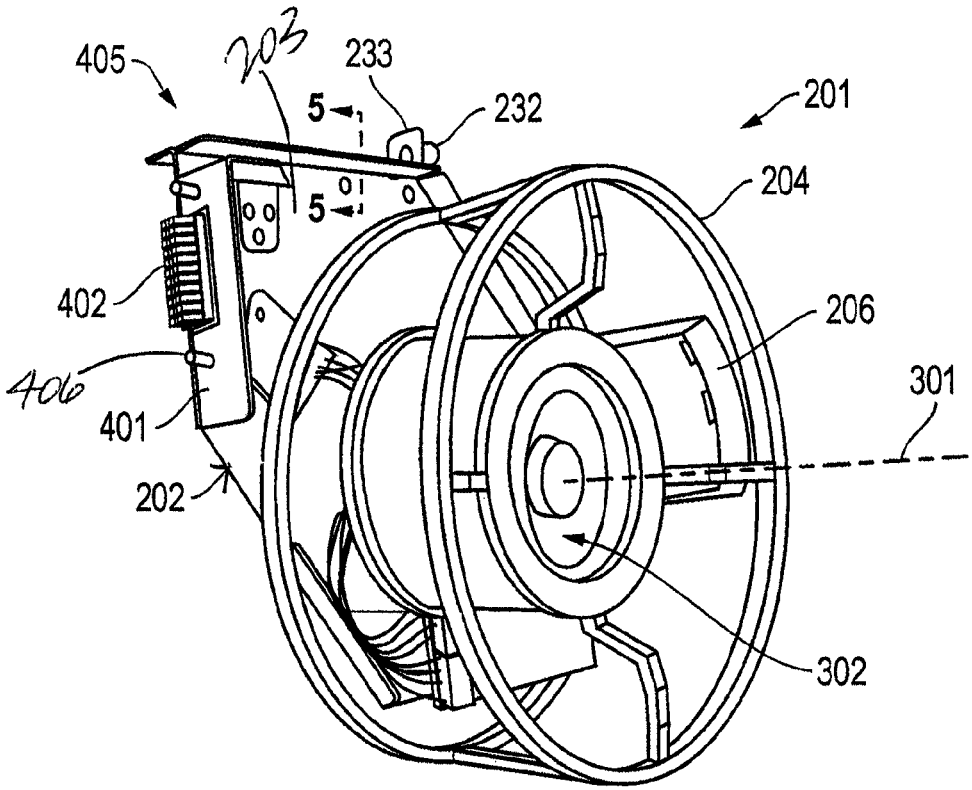
FIG. 4 is a left rear perspective view of the mechanical reel shown in FIG. 2 together with the mounting bracket for the reel.

More of reel superstructure 204 is visible from the rear perspective view of FIG. 4. The perspective of FIG. 4 also shows representations of electrical connectors and wires mounted on the side of mounting bracket 202 on which reel superstructure 204 is located. Top flange 233 and connecting screw 232 are also visible from the perspective shown in FIG. 4, as is the area 302 typically occupied by the reel drive motor.

The rear edge of mounting bracket 202 shown in FIG. 4 includes a rear flange 401 extending substantially perpendicular to the plane of mounting bracket 202. An electrical connector 402 is mounted on rear flange 401 to face away from the remainder of reel assembly 201. Electrical connector 402 is adapted to connect with one of the cabinet electrical connectors 227 shown in FIGS. 2 and 3 when reel assembly 201 is placed in the operating position shown in those figures. This electrical connection between cabinet electrical connector 227 and electrical connector 402 allows electrical power and various control signals to be applied from control equipment (not shown in FIG. 4) that may be mounted in gaming machine cabinet 102. In particular, the electrical power and control signals applied to reel assembly 201 across the connection between cabinet electrical connector 227 and electrical connector 402 operates the reel drive motor and the lights associated with backlight assembly 206. The connection made between electrical connector 402 and cabinet electrical connector 227 also helps stabilize the reel assembly 201 in the desired operating position and resist reactive movements caused by operation of the motor included in the reel assembly. The illustrated form of the invention also includes a stabilizing projection 406 extending from rear flange 401 in position to be received in a respective one of the slots 228 on backplane 224 shown in FIGS. 2 and 3.

Figure 5:
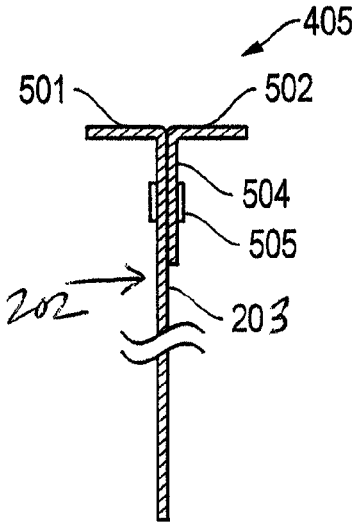
FIG. 5 is section view taken along line 5-5 in FIG. 4.

FIG. 4 also shows that reel assembly 201 includes a T-shaped mounting flange 405. This mounting flange 405 cooperates with a respective one of the slot structures 215 shown in FIGS. 2 and 3 for securing a respective reel assembly 201 in the operating position shown in those figures. Further details of mounting flange 405 are shown in the section view of FIG. 5. In particular, FIG. 5 shows that mounting flange 405 includes an angled portion of mounting bracket 202 which is bent at substantially a right angle with respect to the remainder of the mounting bracket to form a first side (first flange part) 501 of the T-shape of mounting flange 405. A second side (second flange part) 502 of the T-shape of mounting flange 405 comprises a bent portion of a separate stiffening component (base part) 504 that is secured to the remainder of mounting bracket 202 by suitable means. For example, stiffening component 504 may be secured to the remainder of mounting bracket 202 with a number of connectors 505.

Figure 6:
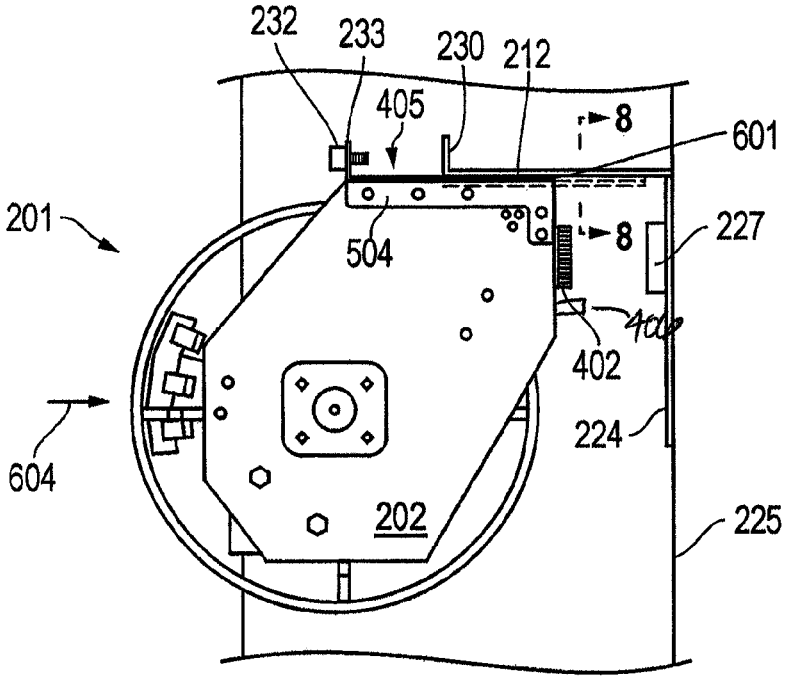
FIG. 6 is a right elevation of a mechanical reel and mounting bracket embodying the principles of the present invention in a partially installed position in a gaming machine cabinet.
Figure 7:
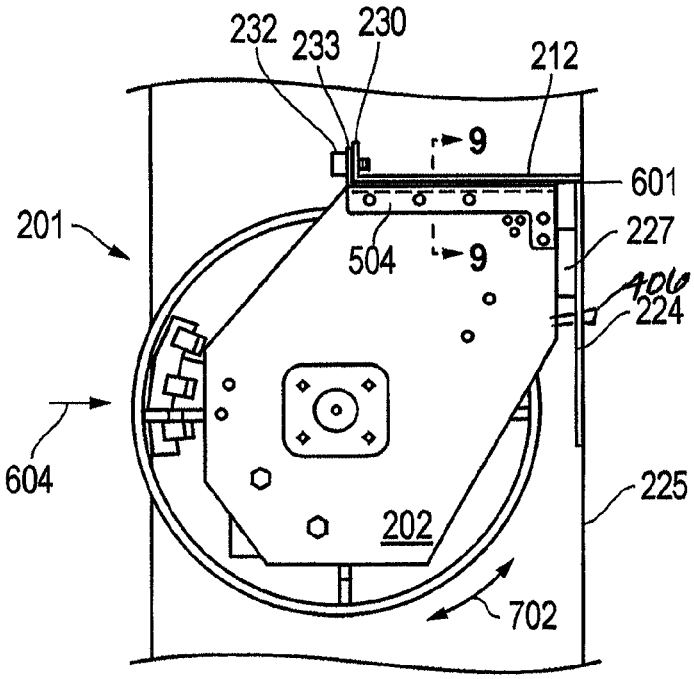
FIG. 7 is a right elevation similar to FIG. 6, but with the mechanical reel and mounting bracket moved to an installed position.

FIG. 6 shows reel assembly 201 partially inserted into slot structure 215 of gaming machine cabinet 102, and FIG. 7 shows the reel assembly fully inserted to the operating position which is also shown in the perspective views of FIGS. 2 and 3. The section view of FIG. 8 shows the slot structure 215 by itself without the mounting flange 405 inserted, and the section view of FIG. 9 shows slot structure 215 with the mounting flange 405 received therein.

Figure 8:
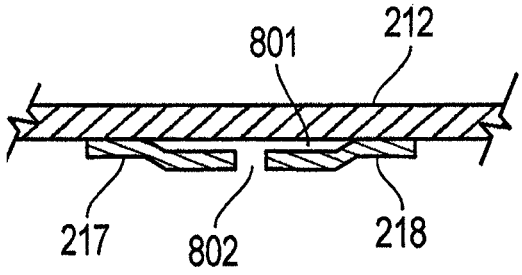
FIG. 8 is a section view taken along line 8-8 in FIG. 6.

Referring first to FIG. 8, the combination of mounting plate 212, and the left side component 217 and right side component 218 of slot structure 215 defines an area 801 for receiving the top of the T-shape making up the T-shaped mounting flange 405. The area 802 between the facing edges of left side component 217 and right side component 218 provides an area for receiving the leg portion of the T-shape. This area 802 along the length of slot structure 215 represents slot 219 referenced above in connection with FIGS. 2 and 3. It will be noted that area 801 in FIG. 8 includes two components, each defined between a respective one of the components 217 and 218 and the bottom surface of mounting plate 212. Namely, a left portion of area 801 is defined between left side component 217 and the lower surface of mounting plate 212, while a right portion of area 801 is defined between right side component 218 and the lower surface of mounting plate 212.

Referring now to FIG. 6, in order to mount a reel assembly 201 according to the invention in a gaming machine cabinet 102, the back edge 601 of the T-shaped mounting flange 405 is aligned with the desired slot structure 215. In particular, the back edge 601 of mounting flange 405 is aligned so that the top of the T-shape, that is, the horizontal part, aligns with the area 801 in FIG. 8 and the uppermost portion of the leg of the T-shape aligns with slot opening 802. With mounting flange 405 so aligned with the desired slot structure, the reel assembly 201 may be moved in the direction of arrow 604 in FIG. 6, to the right in the orientation of the figure. Continuing to move the reel assembly 201 in the direction of arrow 604 ultimately presses electrical connector 402 together with cabinet electrical connector 227 to make the desired electrical connection there between, presses stabilizing projection 406 into a respective slot 228, and also presses the back surface of locking flange 233 against the front surface of upturned flange 230. Connector screw 232 may then be screwed into the respective threaded opening (shown at 235 in FIGS. 2 and 3) to the position shown in FIG. 7.

Figure 9:
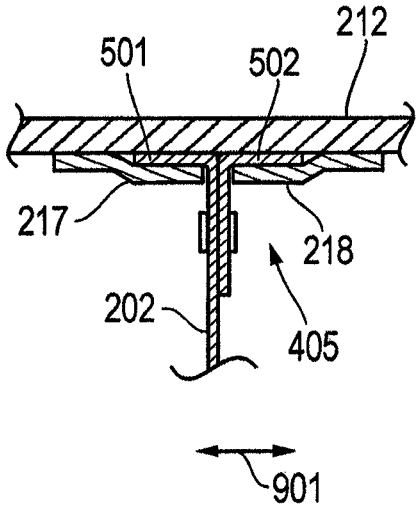
FIG. 9 is a section view taken along line 9-9 in FIG. 7.

FIG. 9 shows the cooperation of mounting flange 405 and slot structure 215 to securely hold reel assembly 201 in the desired operating position. When received in slot structure 215, the top side of the T-shaped flange 405 abuts the lower plane of mounting plate 212, and the leg portion of the T-shape is captured in the slot formed between left and right side components, 217 and 218 respectively. This cooperation prevents any movement of reel assembly 201 from side to side in the direction shown by arrow 901 in FIG. 9. The connection between the electrical connectors 227 and 402, and cooperation of stabilizing projection 406 and slot 228 also help prevent any side to side motion as the motor mounted on reel assembly 201 is operated. Also, the screw connection provided by screw 232 at the front of the mounting bracket 202 prevents reel assembly 201 from moving along the axis of slot structure 215. Of course the screw connection provided by screw 232, the cooperation between slot structure 215 and mounting flange 405, and the connection between electrical connectors 227 and 402 resist any tipping movement of reel assembly which may be induced by the rotation of the reel superstructure 204 in the directions shown by arrows 702 in FIG. 7.

Figure 10:
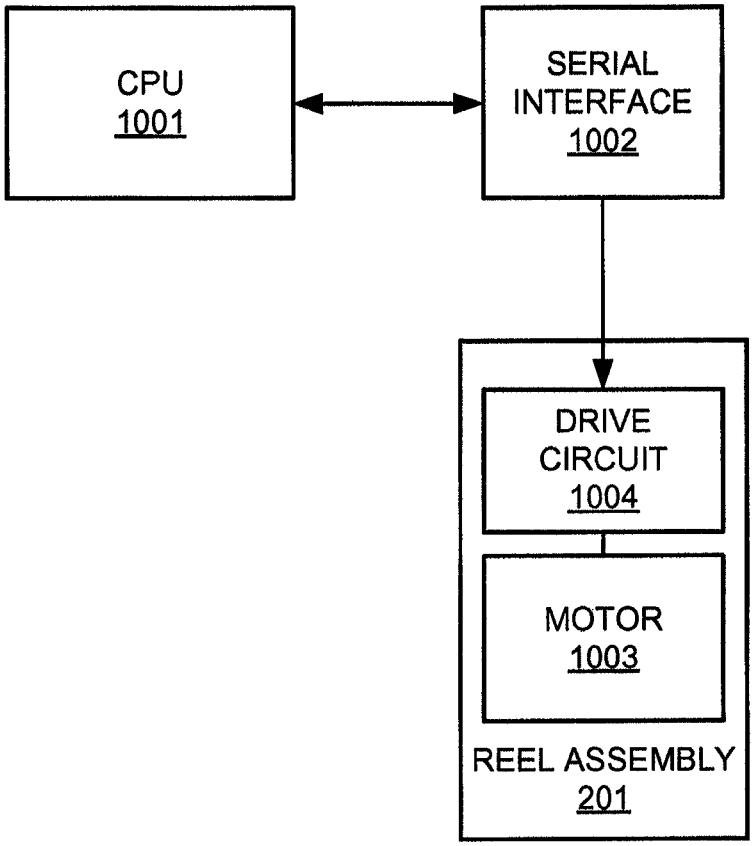
FIG. 10 is a diagrammatic representation showing a control arrangement for the reel assembly motors according to one embodiment of the invention.

FIG. 10 shows a diagrammatic representation of a control arrangement used for a reel assembly 201 according to the present invention. A CPU 1001 or some other type of processing device will typically be included in the gaming machine such as gaming machine 100 in FIG. 1 for controlling the operation of the various gaming machine components, including the reel assemblies 201. A suitable interface arrangement such as serial interface 1002 will be included for accommodating communications between CPU 1001 and the various components it controls. In particular, serial interface 1002 or some other suitable interface may be employed to allow CPU 1001 to send instructions to a drive circuit 1004 for a motor 1003 included in the reel assembly 201. As mentioned above motor 1003 preferably comprises a stepper motor and thus drive circuit 1004 comprises a suitable stepper motor drive circuit for generating signals to drive the stepper motor to control spinning of the respective reel (103 in FIG. 1) and to control the reel stopping orientation for a given play of the game implemented at the gaming machine.

Numerous variations on the example structure shown in the figures are possible within the scope of the present invention. For example, although the T-shaped mounting flange 405 represents one preferred arrangement, other forms of the invention may include a L-shaped flange on the reel bracket and a corresponding receiver mounted on mounting plate 212. Also, the T-shape and the slot structure shown in the example may be reversed such that a slot structure is associated with the reel assembly and the T-shaped flange is associated with the mounting plate 212. Also, numerous different arrangements may be used to form the desired flanges from the sheet metal from which the various reel assembly and corresponding gaming machine cabinet components are formed. Also, although the various brackets and flanges described above are preferably formed from sheet metal, other materials may be used such as rigid plastics. Furthermore, the invention is not limited to use with any particular type of control circuit or arrangement for controlling the reel drive motor. The invention is also not limited to any particular type of reel drive motor.

As used herein the terms "comprising," "including," "carrying," "having," "containing," "involving," and the like are to be understood to be open-ended, that is, to mean including but not limited to. Only the transitional phrases "consisting of" and "consisting essentially of," respectively, shall be considered exclusionary transitional phrases, as set forth, with respect to claims, in the United States Patent Office Manual of Patent Examining Procedures (Eighth Edition, August 2001 as revised September 2007), Section 2111.03.

Any use of ordinal terms such as "first," "second," "third," etc., in the claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

The above described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A reel assembly for a gaming machine, the reel assembly including:

(a) a mounting bracket including a substantially planar mounting bracket body, the mounting bracket further including a first lateral side, a second lateral side, a top edge, a bottom edge, a back edge, and a front edge;

(b) a reel motor connected to the first lateral side of the mounting bracket;

(c) a reel superstructure connected to be driven by the reel motor about a rotational axis extending substantially perpendicular to the plane of the mounting bracket body;

(d) a mounting flange at the top edge of the mounting bracket, the mounting flange extending along the entire length of the top edge of the mounting bracket and including a substantially planar surface lying in a plane extending transversely to the plane of the mounting bracket body, the mounting flange constructed to fit within a receiving structure associated with the gaming machine so that when the reel assembly is in an installed state, the reel assembly is suspended from the receiving structure;

(e) a stabilizing structure located at the rear edge of the mounting bracket in a spaced apart relationship with the mounting flange; and (f) a locking structure located at an intersection of the top edge of the mounting bracket and the front edge of the mounting bracket, the locking structure securing the reel assembly in a predefined position with respect to the gaming machine.

2. The reel assembly of claim 1 wherein the mounting flange includes:

(a) a first flange part extending from one of the first lateral side or the second lateral side of the mounting bracket, the first flange part being integrally formed with the mounting bracket body and comprising an extension from the mounting bracket body bent so as to extend perpendicular to the plane of the mounting bracket body; and (b) a second flange part extending from the other one of the first lateral side or second lateral side of the mounting bracket, the second flange part comprising an extension from a base part which is connected to the mounting bracket, the extension comprising the second flange part being bent with respect to the base part so as to extend perpendicular to a plane of the base part and the plane of the mounting bracket body.

3. The reel assembly of claim 1 wherein the stabilizing structure includes one or more stabilizing projections extending from the rear edge of the mounting bracket.

4. The reel assembly of claim 3 wherein the mounting bracket includes a rear flange located at the rear edge thereof, the rear flange lying in a plane extending substantially perpendicular to the plane of the mounting bracket, and wherein the one or more stabilizing projections extend from the rear flange.

5. The reel assembly of claim 4 further including an electrical connector extending from the rear flange at a location spaced apart from the mounting flange.

6. The reel assembly of claim 1 wherein the locking structure includes:

(a) a locking flange lying in a plane extending substantially perpendicular to the plane of the mounting bracket body and to the plane of the mounting flange; and (b) a fastener mounted on the locking flange.

7. A reel-type gaming machine including:

(a) a cabinet defining an interior volume between two cabinet sides and also defining a front opening;

(b) a front door connected to the cabinet to cover a portion of the front opening when the front door is placed in a closed position, the front door including a viewing panel;

(c) a mounting plate mounted in the interior volume of the cabinet in a location above the viewing panel of the front door when the front door is in the closed position, the mounting plate extending laterally between the cabinet sides;

(d) for each reel to be included in the gaming machine a respective slot structure, each slot structure being supported on the mounting plate and including a downwardly facing slot defined between a first side component and a second side component, and further including a receiver area made up of (i) a first side receiver area defined between a lower surface of the mounting plate and a portion of the first side component, and (ii) a second side receiver area defined between the lower surface of the mounting plate and a portion of the second side component, the slot structure being constructed so that when a reel is in an installed position, the reel is suspended from the mounting plate;

(e) each slot structure being associated with a respective stabilizing receiver, the respective stabilizing receiver being positioned on a back structure of the gaming machine directly below the respective slot structure with which it is associated;

(f) each slot structure also being associated with a respective electrical socket mounted at a back of the cabinet; and (g) each slot structure also being associated with a respective lock element located at a front edge of the mounting plate adjacent to the respective slot structure with which it is associated, each lock element securing the respective reel in a predefined position with respect to the mounting plate.

8. The gaming machine of claim 7 further including a respective reel assembly for each respective slot structure, each respective reel assembly including:

(a) a mounting bracket including a substantially planar mounting bracket body, the mounting bracket further including a first lateral side, a second lateral side, a top edge, a bottom edge, a back edge, and a front edge;

(b) a reel motor connected to the first lateral side of the mounting bracket;

(c) a reel superstructure connected to be driven by the reel motor about a rotational axis extending substantially perpendicular to the plane of the mounting bracket body;

(d) a mounting flange at the top edge of the mounting bracket, the mounting flange including a substantially planar surface lying in a plane extending transversely to the plane of the mounting bracket body;

(e) a stabilizing structure located at the rear edge of the mounting bracket in a spaced apart relationship with the mounting flange;

(f) a locking structure located at an intersection of the top edge of the mounting bracket and the front edge of the mounting bracket; and (g) wherein the mounting flange is received in the receiver area of a respective one of the slot structures with the mounting bracket body received in the slot of that respective slot structure with the rear edge of the mounting bracket against the backplane, with the stabilizing structure received by the stabilizing receiver associated with that respective slot structure, and with the locking structure cooperating with the locking element of that respective slot structure to lock the reel assembly in place relative to that respective slot structure, and wherein an electrical connector of the reel assembly is operatively connected with the electrical socket of that respective slot structure.

9. The gaming machine of claim 8 wherein the stabilizing receiver associated with each slot structure includes a stabilizing slot having a first width dimension and wherein the stabilizing structure associated with each reel assembly includes a projection having substantially the first width dimension received in the respective stabilizing slot.

10. The gaming machine of claim 9 further including a cabinet electrical connector which makes a connection with an electrical connector located at the rear edge of the mounting bracket in a spaced apart relationship with the mounting flange.

11. The gaming machine of claim 8 wherein the mounting flange of the reel assembly mounted in the respective slot structure includes a first flange part extending from the first lateral side of the mounting bracket, and a second flange part extending from the second lateral side of the mounting bracket so that the first flange part and second flange part together form a T-shape with the mounting bracket body.

12. The gaming machine of claim 8 wherein:

(a) the locking structure includes a locking flange lying in a plane extending substantially perpendicular to the plane of the mounting bracket body and a male threaded fastener mounted on the locking flange; and (b) the lock element of the respective slot structure includes a threaded opening adapted to threadingly receive the male threaded fastener.

13. The gaming machine of claim 8 wherein the mounting plate comprises a sheet of rigid planar material having a first lateral edge supported at a first one of the two cabinet sides and having a second lateral edge supported at a second one of the two cabinet sides so that the mounting plate lies in substantially a horizontal plane when the gaming machine is in the operating position.

14. A gaming machine including:

(a) a cabinet defining an interior volume and a front opening;

(b) a front door connected to the cabinet to cover a portion of the front opening when the front door is placed in a closed position, the front door including a viewing panel;

(c) a number of reel assemblies, each reel assembly including, (i) a mounting bracket including a substantially planar mounting bracket body, the mounting bracket further including a first lateral side, a second lateral side, a top edge, a bottom edge, a back edge, and a front edge, (ii) a reel motor connected to the first lateral side of the mounting bracket, (iii) a reel superstructure connected to be driven by the reel motor about a rotational axis extending substantially perpendicular to the plane of the mounting bracket body, (iv) a mounting flange at the top edge of the mounting bracket, the mounting flange extending the entire length of the top edge of the mounting bracket and including a substantially planar surface lying in a plane extending generally perpendicular to the plane of the mounting bracket body, (v) a stabilizing projection extending from the rear edge of the mounting bracket in a spaced apart relationship to the mounting flange, and (vi) a locking structure located generally at an intersection of the top edge of the mounting bracket and the front edge of the mounting bracket, the locking structure securing the reel assembly in a predefined position with respect to the gaming machine;

(d) a mounting plate located in the cabinet above the level of the viewing panel when the gaming machine is in the operating position and the front door is in the closed position, each respective reel assembly having its respective mounting flange received in a respective slot structure associated with the mounting plate so that each of the reels is suspended from the mounting plate, and the rotational axis of each reel superstructure is aligned along a common axis extending through the interior volume of the cabinet substantially parallel to the plane of the viewing panel; and (e) a cabinet back located in the cabinet below the mounting plate, the cabinet back including a stabilizing slot for each reel assembly, each respective stabilizing slot being located so that the respective stabilizing projection of a respective reel assembly is received therein.

15. The gaming machine of claim 14 wherein:

(a) the mounting plate includes a front flange; and (b) the locking structure of each reel assembly includes a respective threaded element threaded into a respective corresponding threaded opening in the mounting plate front flange.

16. The gaming machine of claim 15 wherein the respective mounting flange of each respective reel assembly is received in a respective slot structure associated with the mounting plate.

17. The gaming machine of claim 16 wherein each slot structure includes a downwardly facing slot defined between a first side component and a second side component, and further includes a receiver area made up of (i) a first side receiver area defined between the first side component and the mounting plate, and made up of (ii) a second side receiver area defined between the second side component and the mounting plate.

* * * * *